US005329751A

United States Patent [19]

Wadsworth

[11] Patent Number: 5,329,751

[45] Date of Patent: Jul. 19, 1994

[54] VENTILATING PNEUMATIC ANIMAL HARNESS

[76] Inventor: LeGrand Wadsworth, Rt. #1, Box 168, St. Ignatius, Mont. 59865

[21] Appl. No.: 994,991

[22] Filed: Dec. 22, 1992

[51] Int. Cl.[5] ..... B68C 1/12; B68C 1/14

[52] U.S. Cl. ..... 54/23; 54/66

[58] Field of Search ..... 54/19.2, 23, 44.6, 65, 54/66; 5/456; 297/200, DIG. 3

[56] References Cited

U.S. PATENT DOCUMENTS

| | | | |
|---|---|---|---|
| 77,701 | 5/1868 | Youngblood . | |
| 426,042 | 4/1890 | Mudford . | |
| 481,289 | 8/1892 | Underwood | 54/66 |
| 539,709 | 5/1885 | Short . | |
| 550,380 | 11/1895 | Plumhoff . | |
| 709,930 | 9/1902 | Rensman | 54/66 |
| 791,787 | 1/1905 | Howard . | |
| 809,276 | 1/1906 | Aulton | 54/65 |
| 852,593 | 7/1906 | Benbow | 54/44.6 |
| 910,689 | 1/1909 | Kelly et al. | 54/66 |
| 2,221,042 | 11/1940 | Carter | 54/19 |
| 3,343,338 | 9/1967 | Stubben . | |
| 4,108,492 | 8/1978 | Kirby | 297/DIG. 3 X |

FOREIGN PATENT DOCUMENTS

| | | | |
|---|---|---|---|
| 3000387 | 7/1981 | Fed. Rep. of Germany | 54/23 |
| 1514 | 1/1906 | United Kingdom . | |

*Primary Examiner*—Robert P. Swiatek
*Attorney, Agent, or Firm*—Keith S. Bergman

[57] ABSTRACT

Animal harness, including blankets and straps, provides low pressure internal pneumatic elements to aid in padding harness effect on an animal and in ventilating animal body portions thereunder. A blanket provides an air pervious felt element folded upon itself and sewn to form a plurality of adjacent open-ended pockets, each carrying an inflatable bicycle tire inner tube deformed to fit in a pocket with two side-by-side courses. The felt element is covered by an air pervious fabric cover. A harness strap provides two similar mesh side elements joined about adjacent peripheral edges by banding to define a medial channel. A strap having connectors at each end and a medial cross strap is joined to the outer surface of one mesh side element for strength and to allow fastening to other harness structure. The medial channel defined by the strap carries an inflatable bicycle tire inner tube deformed to an elongate shape. Motion of an animal and supported load cause responsive deformation in the pneumatic harness elements that results in a pumping action that moves air sequentially toward and away from animal portions beneath the harness elements.

4 Claims, 2 Drawing Sheets

FIG. 6
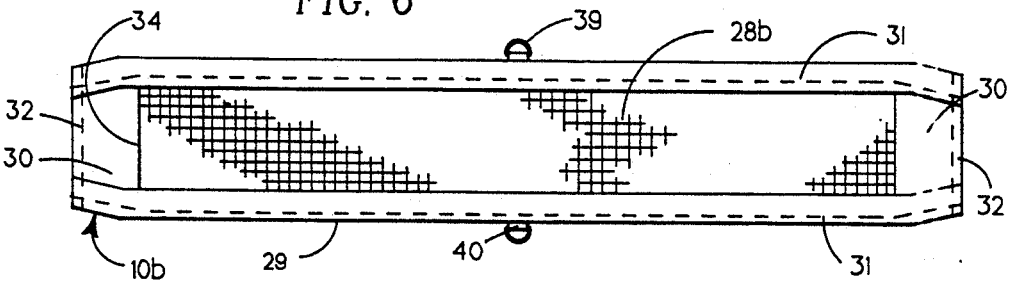
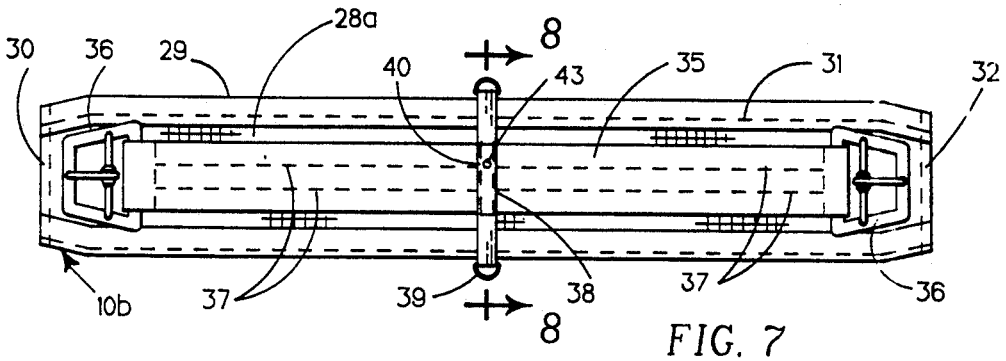
FIG. 7
FIG. 8
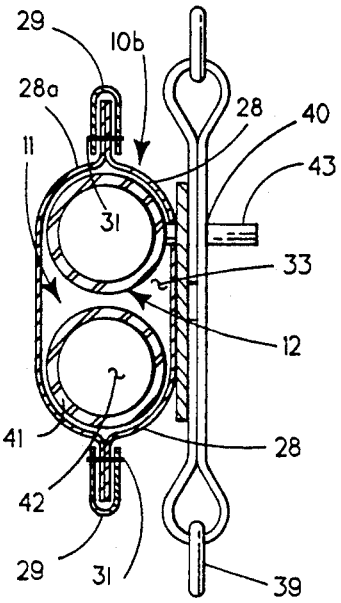
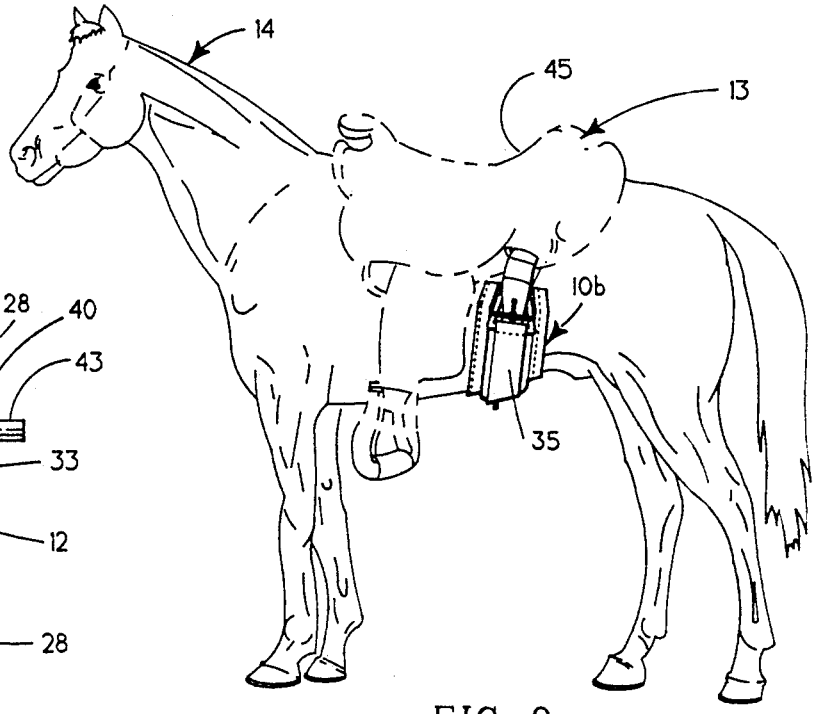
FIG. 9

VENTILATING PNEUMATIC ANIMAL HARNESS

BACKGROUND OF INVENTION

RELATED APPLICATIONS

There are no applications related hereto heretofore filed in this or any foreign country.

1. Field of Invention

My invention relates generally to padded animal harness having low pressure elastic pneumatic elements, and more particularly to such harness that is air permeable to cause ventilation therebeneath.

2. Background and Description of Prior Art

Since its early history animal harness has been padded in various manners to make it more comfortable and less damaging to an animal and to aid in positional maintenance. In the more recent history of harness pneumatic elements of various sorts, carried either in or on the harness or sometimes associated with it, have become known for such purposes. The instant invention provides a new, novel and improved member of pneumatically padded harness.

Harness by its nature must have sufficient strength and configurationally sustaining deformability to fulfill its purpose. This requirement generally has resulted in the use of harness materials that are relatively impervious to both air and liquid such as leather, the most commonly used harness material. Harness by reason of the nature of its use must necessarily fit in close adjacency with portions of an animal which it spans. This in the past has caused sweating and prevented air access to covered portions of an animal's skin often to cause skin irritation, commonly referred to as "galling", by reason of the synergistic action of abrasion and motion of harness and the moist conditions of both harness and animal. The prior harness art has generally not adequately considered this problem nor dealt with it sufficiently to provide meaningful solutions.

My invention provides harness that is air permeable to allow ventilation of an animal's skin underlying the harness to aid in resolving the galling problem. My blanket has a central pad of felted fibrous material which allows relatively free passage of air therethrough, and the pad has a fabric covering that is loosely woven to be as air permeable as the felted pad. My strap is formed with similar mesh side elements that allow free passage of air therethrough while the efficiency and utility of the strap is maintained by a traditional leather strap carried only on the medial portion of one outer side of the mesh side element that is distal from an animal's body to allow air flow to the covered body portion.

To further aid padding and ventilation of my harness, I provide medial low pressure pneumatic elements extending over a substantial portion of the area of a harness element. My blanket pads are formed with a plurality of adjacent elongate pockets, each carrying an elastic pneumatic element such as a bicycle tire inner tube deformed into two adjacent linear courses with folded interconnecting ends. My strap harness provides a pocket between mesh sides to carry a similar elongate pneumatic element. The pneumatic elements are inflated to a pressure of approximately one pound above that of the ambient atmosphere so that when force is applied on the harness elements by an animal, a load or a rider, those elements change configuration. In so doing various portions of the harness move, to create somewhat of a pneumatic pumping action that causes air to move between the two sides of the harness and thus ventilate the body portions of an animal beneath the harness.

My invention resides not in any one of these features individually, but rather in the synergistic combination of all of its structures that give rise to the functions necessarily flowing therefrom as specified and claimed.

SUMMARY OF INVENTION

The instant invention provides animal harness including blankets and straps that contain low pressure elastic pneumatic elements to pad the harness and cause ventilation therethrough. The blanket provides a pad of air permeable felted material defining elongate pockets with open ends to receive pneumatic elements. The pad is carried in a porous cover that is permeable by air. The strap provides elongate mesh sides with peripheral binding to define an elongate pocket therebetween. The outside of the strap element carries an ordinary leather strap with end buckles and medial cross strap with fasteners. The pockets of the harness carry pneumatic elements inflated to low pressure of about one pound above the ambient atmosphere so that motion of an animal and any load cause deformation of the harness that tends to ventilate portions of an animal therebeneath.

In providing such articles, it is:

A principal object to provide animal harness that is pneumatically padded and provides ventilation therethrough during use.

A further object is to provide such harness that defines at least one elongate pocket to carry an elastic pneumatic element inflated to low pressure so as to move during use to both pad the harness and cause air motion therethrough.

A still further object is to provide a blanket having plural adjacent pneumatic elements carried by an air permeable pad in turn carried in a removable air permeable protective covering.

A still further object is to provide a strap having a body formed of air permeable material with a traditional strap carried on the outer surface thereof.

A still further object is to provide such harness that is of new and novel design, of rugged and durable nature, of simple and economic manufacture and otherwise well adapted to the uses and purposes for which it is intended.

Other and further objects of my invention will appear from the following specification and accompanying drawings which form a part hereof. In carrying out the objects of my invention, however, it is to be remembered that its accidental features are susceptible of change in design and structural arrangement with only one preferred and practical embodiment of the best known mode being illustrated and specified as is required.

BRIEF DESCRIPTION OF DRAWINGS

In the accompanying drawings which form a part hereof and wherein like numbers of reference refer to similar parts throughout:

FIG. 6 is an orthographic view of the inner surface of a strap-type harness element.

FIG. 7 is an orthographic view of exterior surface of the strap-type element illustrated in FIG. 6.

FIG. 8 is a traverse cross-sectional view through the strap-type element of FIG. 7, taken on the line 8—8 thereon in the direction indicated by the arrows.

FIG. 9 is an orthographic side view of the strap-type element in use on a horse to support a saddle shown in dashed outline.

DESCRIPTION OF THE PREFERRED EMBODIMENT

Figure 1:
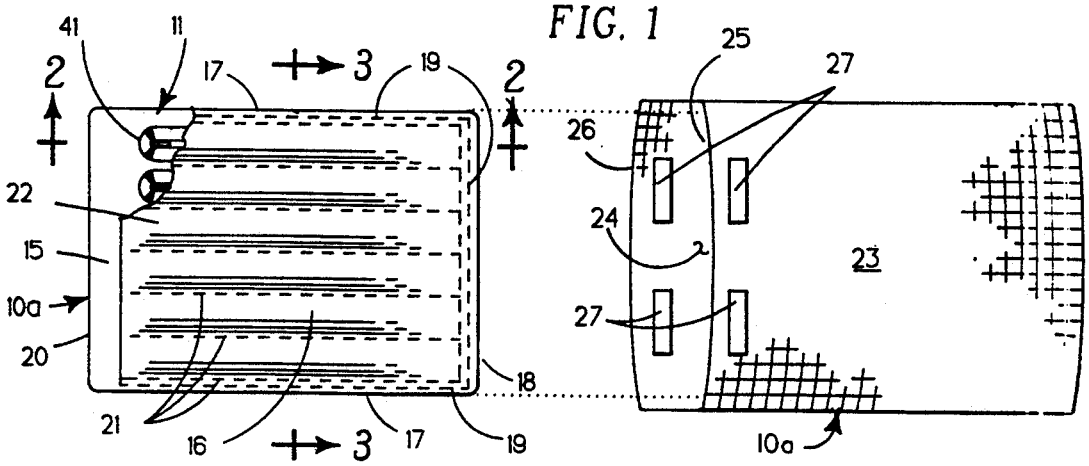
FIG. 1 is an orthographic surface view, partially cut-away, showing the pad structure of a blanket and its removed cover.
Figure 2:
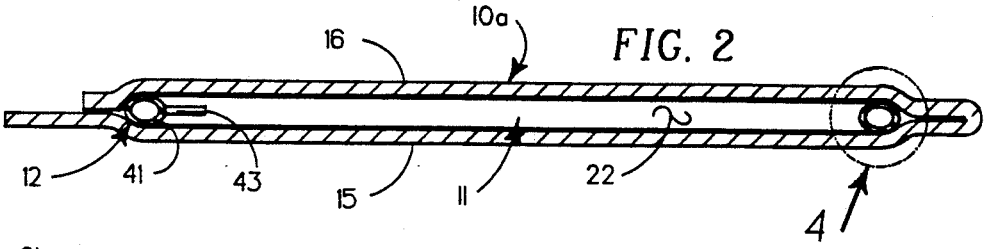
FIG. 2 is an elongate cross-sectional view through the pad structure of the blanket of FIG. 1, taken on the line 2—2 thereon in the direction indicated by the arrows.
Figure 3:
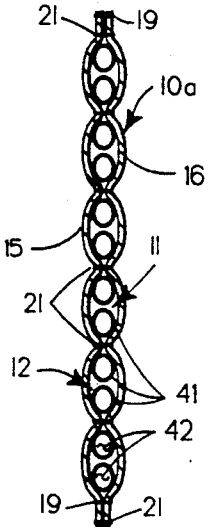
FIG. 3 is a traverse cross-sectional view through the pad structure of the blanket of FIG. 1, taken on the line 3—3 thereon in the direction indicated by the arrows.
Figure 4:
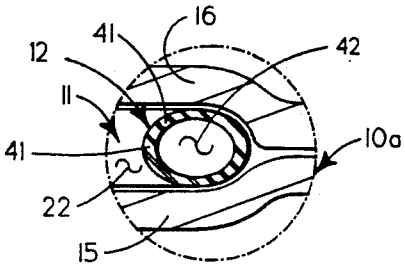
FIG. 4 is an enlarged portion of the cross-section of FIG. 2 better illustrating the details of the structure indicated in the dashed circle 4 on FIG. 2.

My invention generally provides animal harness including blanket 10*a* and strap 10*b*, each defining at least one elongate internal pocket 11 to hold pneumatic elements 12 which support load holding devices 13 on animal 14.

Though my "harness" is shown as being used on a horse, it should be understood that the term is intended to be generic and may include harness used on other animals that carry loads, such as donkeys, mules, llamas, cows and dogs. The terms "inside" and "outside" as used herein are used with reference to an animal supporting my harness, with "inside" being proximal to the animal and "outside" being distal from it.

Blanket 10*a* includes a rectilinear pad formed by folding an elongate strip of material upon itself to create inner element 15 and outer element 16. In the instance illustrated, the fold is asymmetrical to make inner element 15 slightly longer than the outer element to protect a horse from pneumatic valving fixtures that might project somewhat from the outer element 16. The sides 17 and end 18 of the pad are fastened together by sewn seams 19. The ends 20 of both inner and outer elements are not fastened.

Internal pockets 11 are defined in the pad by a plurality of seams 21 sewn between the pad elements 15, 16 in spaced array parallel to sides 17. These seams 21 extend from end 20 of outer element 16 to the seam 19 medially inwardly adjacent pad end 18 to define plural adjacent elongate pockets 22 between the inner and outer blanket elements.

Preferably the pad 15, 16 is covered by pocket-like cover 23 defining internal chamber 24 configured to receive the pad element in a flat configuration. One end portion of the cover 23 defines orifice 25 and cover flap 26 which may be folded over the orifice to releasably maintain a pad within the internal chamber. The cover flap and cover portion adjacent thereto when in a covering mode carry fastenably engageable hook and loop fabric fasteners 27 to releasably maintain the cover flap in covering position.

The size and configuration of my blanket are not particularly critical to its functioning, though for convenience of use the configuration is preferably maintained in the traditional size of approximately three by four feet. The sizing of the internal pockets 11 is critical only in that it must be such as to receive the pneumatic tubes which those pockets are to carry.

The material from which the blanket pad and cover are formed is critical and must be such as to be permeable by air and generally, the efficiency of ventilation through my harness varies rather directly with the air permeability of those elements. For the pad element, I prefer to use a felted fiber or hair material of the type commonly used in harness padding of the present day, and I prefer that that material should have a thickness of approximately one-half inch. That material generally is felted sufficiently that it provides configurationally sustaining resiliency with substantial durability, but yet is sufficiently porous to provide substantial air permeability. I prefer to form cover 23 from a cloth that is sufficiently loosely woven as to provide at least as great permeability as does the blanket pad and in general such material is more comfortable of use if at least its outer surface has a nap or pile extending from the woven base.

Strap 10*b* illustrated in FIGS. 6–9 is a girth typical of any harness strap embodying my invention. The strap provides a body formed by similar elongate mesh sides 28 having elongate peripheral elements 29 comprising strips folded upon themselves to cover the outer portion of each mesh side spacedly inwardly from the peripheral edges. Each end portion of the mesh sides is covered by an end element 30 folded upon itself to extend over the adjacent outer end portions of the mesh sides, as illustrated in FIGS. 6 and 7. The side peripheral elements 29 are fastened to the adjacent mesh surfaces by sewn seams 31 extending therebetween, and the end elements are similarly joined to the adjacent mesh side ends by end seams 32 to provide a strap body defining internal pocket 33 to carry a pneumatic tube.

Slit 34 is defined in one side of one peripheral end element 30 and through the mesh side adjacent thereto to create an orifice to allow placement and removal of a pneumatic tube in pocket 33. Side elements 29 extend only a short distance inwardly from the periphery of mesh sides 28 that is sufficient to allow fastening by seaming, and end elements 30 extend a somewhat greater distance to provide some protection to the mesh elements from associated buckle structures. The peripheral side and end elements are configured so as to define a substantial open window of mesh in the medial portion of the strap body.

Elongate strap 35, carrying ordinary harness buckles 36 at each end, is interconnected in the medial portion of outer mesh side 28*a* the body by sewn seams 37. The strap 35 and strap body preferably are so configured that buckles 36 at the ends of strap 35 extend over end elements 30 and the strap itself leaves an exposed portion of a mesh side 28 between each strap and adjacent peripheral elements 29 to allow adequate air passage through the mesh elements. Strap 35 may carry shorter cross strap 38 having "D" rings 39 in each end to allow interconnection of other harness elements. An orifice 40 is defined through both strap 35 and cross strap 38 to allow passage of valve fixture 43 of an associated pneumatic tube therethrough.

Pneumatic elements 12, illustrated particularly in FIGS. 1–4 and 8, provide ordinary bicycle tire inner tubes 41 defining internal pneumatic chamber 42 having valve fixture 43 communicating therewith and projecting therefrom. The pneumatic elements associated with either the blanket or strap form of my invention are substantially similar. For placement, the inner tubes are deflated and manually formed into the elongate configurations illustrated with the sides in adjacency and then placed in the internal pockets 11 of my harness. In the case of the blanket structure, the inner tubes are so placed that valve fixtures 43 extend from the open ends of the pad, and in the strap device the fixtures are placed to extend outwardly through orifice 40, so that in either structure the fixtures may be accessed after placement for inflation or deflation of the tubes.

Though bicycle inner tubes are preferred as pneumatic elements in my harness, they are not necessary and various other similarly shaped pneumatic devices having valve structure and a pressure chamber defined by elastically resilient material may be used. In fact, pneumatic elements having no valve fixture 43 and predetermined pneumatic pressure may be used, though they are not particularly feasible because they allow no adjustment and, if punctured, they are relatively difficult to repair and replace.

Having described the structure of my harness, its use may be understood.

Figure 5:
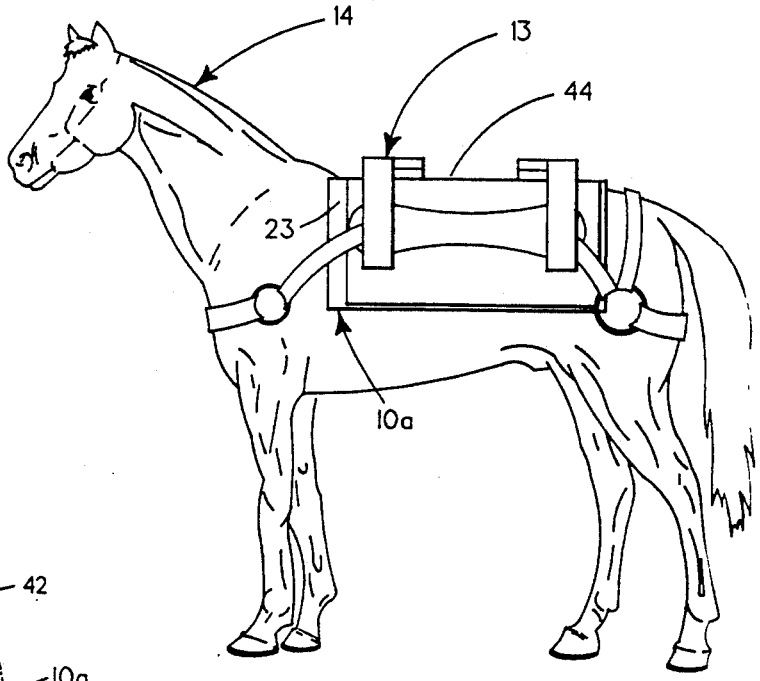
FIG. 5 is an orthographic side view of my blanket in use on a horse supporting a pack-type saddle.

In the case of a blanket formed according to the foregoing specification, the pad with pneumatic elements 15, 16 in place is placed within cover 23. Air pressure is established in the pneumatic elements through valve fixtures 43 to a relatively low pressure of approximately one to five pounds per square inch. Cover flap 26 is then closed and releasably fastened by fasteners 27. The blanket with inflated pneumatic elements is then placed on a horse's back in normal position for use with a saddle and with the elongate dimension of the pneumatic elements extending substantially parallel to the animal's back, normally with the seam between two pneumatic elements being immediately above the animal's back bone. In this position saddle structure 13, illustrated in FIG. 5 as comprising a pack-type saddle 44, is placed over the blanket and fastened for positional maintenance by the traditional ancillary harness.

In use, my pneumatic harness provides both padding and ventilation for an animal by reason of the motion of both the animal and a supported load. The felted fiber padding used to form the core of the blanket is commonly used in either single or double thicknesses as traditional padding beneath saddles, so my blanket provides that same padding effect plus the additional padding effect created by the medial pneumatic elements carried between the inner and outer pad elements to provide substantially greater overall padding than is provided by traditional non-pneumatic pads.

It is to be noted in this regard that the surfaces of a load supported by a padding element and ultimately by a pack animal generally have substantial areal extent that is greater than the distance between two adjacent pneumatic elements so that a load supported by my pad generally will be supported by plural pneumatic elements. This type of support distributes the ultimate supported load over substantial area and by reason of the deformation of the pneumatic elements responsive to the load they support, the elements will tend to increase the overall supportative surface area. Additionally, the pneumatic elements will tend to absorb and dissipate over substantially larger areas any force or impact thereon than will firmer homogenous structures such as felted padding by itself, to provide a substantially more effective animal pad than is provided by non-pneumatic padding.

The pneumatic elements also tend to aid air circulation through the permeable pad and cover of the blanket by reason of their deformation responsive to changed loads and forces caused by load and animal motion. Responsive to this configurational change in the pneumatic elements, air of the ambient atmosphere is moved through and about the blanket and thusly to and from the area between the adjacent surfaces of blanket and animal. A felted fiber pad has substantially less motion than my pneumatic pad and because of this, provides substantially less ventilation of animal portions beneath the pad.

In this regard, it is important to note that the pneumatic tubes of my blanket contain only a relatively low air pressure of a few pounds per square inch above atmospheric pressure. This air pressure must be adjusted to some degree responsive to the load to be carried by an animal and the distribution and manner of support of that load on an animal. The pressure in the pneumatic element should be sufficient to provide some space between opposed sides of the pneumatic element in most blanket areas to provide adequate padding, but yet the pressure should not be much greater than to do this so that the motion of an animal and supported load will cause ever changing configurational patterns of the pneumatic support to provide appropriate ventilation of the animal portions beneath the pad. With normal loads and ordinary saddle types, this required pneumatic pressure will generally range from somewhere between one and five pounds per square inch. The particular pressure required in an individual instance may be readily determined emperically according to the foregoing standards.

The operation of my girth is substantially similar to that of the blanket. A girth formed according to the foregoing specification is established on a horse in normal fashion, as illustrated in FIG. 9, to positionally maintain riding saddle 45. The girth is established with inner mesh side **28*b* adjacent the animal and outer mesh side 28*a* carrying strap 35 distal from the animal. The pneumatic element 12 is inflated to low air pressure and buckle ends of strap 35** are interconnected to associate the saddle harness in the normal fashion to positionally maintain the saddle.

The girth strap operates in substantially the same fashion as the blanket of my harness. The pneumatic element in the strap body is beneath strap 35 so as to provide cushioning between that strap and the underlying portion of an animal. As the animal, its rider or both move during transport, the forces on the strap body tend to change somewhat in both amount and position, and this in turn causes different configurations of the pneumatic elements. As the pneumatic element configuration changes somewhat of a pumping action is created in the body structure to move air to and away from different portions thereof to cause ventilation of the whole structure and especially the portion of an animal therebeneath.

It should be noted that my pneumatic harness has additional secondary benefit in that it tends to positionally maintain harness in better fashion than similarly configured non-pneumatic harness elements. The deformation of the pneumatic elements tends to provide a conformal fit of the pneumatic harness with the animal surface therebeneath to tend to prevent shifting of the harness relative to that animal. In the case of my blanket, the ridge of the back of an animal tends to be positioned between pneumatic elements and since those pneumatic elements run parallel to the direction of the back ridge, there is substantially less tenancy for a load to move the blanket laterally to either side of the animal than with a blanket not having such pneumatic elements. Similarly, when the girth is placed about the underside of an animal, it tends to remain in constant contact with the surface of the animal therebeneath during locomotion and breathing functions so that there is substantially less tendency of a supported saddle to move laterally out of proper position on the horse's back. This function is synergistically enhanced if a pneumatic girth be used in combination with a pneumatic blanket.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and what I claim is:

1. A ventilating pneumatic blanket for load carrying animals, comprising in combination:

a blanket pad formed of air permeable material and defining a plurality of sequentially adjacent internal pockets, each internal pocket being substantially parallel to a longer side of the blanket pad and having an opening thereto;

a plurality of bicycle tire inner tubes, deformed to have two elongate side by side courses interconnected at each end, one said inner tube carried within each internal pocket, each said inner tube having a valving fixture accessible through the opening to each internal pocket and being inflated with gas to a pressure between approximately one and five pounds per square inch above the pressure of the ambient atmosphere; and an air permeable cover covering the blanket pad and having an opening to allow the blanket pad to be placed and removed therefrom.

2. A ventilating pneumatic harness strap for load carrying animals, comprising in combination:

an elongate strap body having similar elongate mesh sides jointed by peripheral banding extending about the periphery thereof to define an air permeable internal pocket having an opening for access thereto;

a strap, having means for releasable interconnection to harness elements, operably carried by one elongate side of the strap body; and a bicycle tire inner tube configured into two elongate side by side interconnected courses to fit within the internal pocket, said inner tube having a valving fixture accessible through the opening and being inflated with gas to a pressure between approximately one and five pounds per square inch above the pressure of the ambient atmosphere.

3. Ventilating pneumatic animal harness, comprising in combination:

a harness member comprising a rectilinear blanket formed of resilient air permeable material having a felted fiber pad defining a plurality of spaced parallel open ended internal pockets to receive and positionally maintain a deformable pneumatic element, said pad being removably encased in an air permeable cover, and the internal pockets each carrying a pneumatic element comprising a bicycle tire inner tube configured in two side-by-side courses to fit within each internal pocket, said bicycle tire inner tube carrying gas at a pressure between one and five pounds per square inch above the ambient atmosphere and having valving means to maintain air therein and selectively allow input and exit of air therefrom.

4. Ventilating pneumatic animal harness, comprising in combination:

a harness member comprising a strap body formed of resilient air permeable material with elongate mesh sides joined by peripheral banding to define at least one internal pocket to receive and positionally maintain a deformable pneumatic element, said strap body carrying on one outer surface a second strap having means for interconnection with other harness elements, and said at least one internal pocket carrying a bicycle inner tube configured in two elongate side-by-side courses to fit within the at least one internal pocket, said bicycle tire inner tube carrying gas at a pressure between one and five pounds per square inch above the ambient atmosphere and having valving means to maintain air therein and selectively allow input and exit of air therefrom.

* * * * *